US008564485B2

(12) United States Patent
Milosavljevic et al.

(10) Patent No.: US 8,564,485 B2
(45) Date of Patent: Oct. 22, 2013

(54) ADJUSTABLE MULTIBAND ANTENNA AND METHODS

(75) Inventors: Zlatoljub Milosavljevic, Kempele (FI); Antti Leskelä, Oulu (FI); Christian Braun, Stockholm (SE)

(73) Assignee: Pulse Finland Oy, Kempele (FI)

( * ) Notice: Subject to any disclaimer, the term of this patent is extended or adjusted under 35 U.S.C. 154(b) by 870 days.

(21) Appl. No.: 11/989,451

(22) PCT Filed: Jul. 13, 2006
(Under 37 CFR 1.47)

(86) PCT No.: PCT/FI2006/050341
§ 371 (c)(1),
(2), (4) Date: Jul. 27, 2009

(87) PCT Pub. No.: WO2007/012697
PCT Pub. Date: Jan. 2, 2007

(65) Prior Publication Data

US 2010/0295737 A1 Nov. 25, 2010

(30) Foreign Application Priority Data

Jul. 25, 2005 (FI) ..... 20055420

(51) Int. Cl.
*H01Q 1/24* (2006.01)

(52) U.S. Cl.
USPC ..... 343/702; 343/700 MS; 343/745; 343/749

(58) Field of Classification Search
USPC ..... 343/722, 745, 749, 702, 700 MS
See application file for complete search history.

(56) References Cited

U.S. PATENT DOCUMENTS 2,745,102 A 5/1956 Norgorden (Continued)

FOREIGN PATENT DOCUMENTS

CN 1316797 10/2007
DE 10015583 11/2000

(Continued)

OTHER PUBLICATIONS

"An Adaptive Microstrip Patch Antenna For Use In Portable Transceivers", Rostbakken et al., Vehicular Technology Conference, 1996, Mobile Technology for the Human Race, pp. 339-343.

(Continued)

*Primary Examiner* — Tan Ho
(74) *Attorney, Agent, or Firm* — Gazdzinski & Associates, PC

(57) ABSTRACT

An adjustable multi-band planar antenna especially applicable in mobile terminals and a radio device. The adjusting circuit (430) of the antenna is galvanically connected to a point (X) of the radiator, where the circuit can affect the places of at least two operating bands. The adjusting circuit comprises a multi-pole switch (433), by which said radiator point can be connected to one of alternative transmission lines. For example, one of two transmission lines (434, 435) is open and another shorted. A discrete capacitor (C2) can be located between the separate conductor of the transmission line and an output pole of the switch as an additive-tuning element. The adjusting circuit further comprises a LC circuit (432) between the radiator (320) and the switch. Among other things, the lengths of the transmission lines, the values of the discrete components and the distance between the antenna short-circuit point (G) and the adjusting circuit connecting point (X) are then variables from the point of view of the antenna adjusting. Such values are calculated for these variables that each of the antenna operation bands separately shifts to a desired other place when the switch state is changed. The space required for the adjusting circuit is relatively small, and a relatively high efficiency is achieved for the antenna despite of the use of a switch.

39 Claims, 5 Drawing Sheets

(56) References Cited

U.S. PATENT DOCUMENTS

| | | | |
|---|---|---|---|
| 3,938,161 | A | 2/1976 | Sanford |
| 4,004,228 | A | 1/1977 | Mullett |
| 4,028,652 | A | 6/1977 | Wakino et al. |
| 4,031,468 | A | 6/1977 | Ziebell et al. |
| 4,054,874 | A | 10/1977 | Oltman |
| 4,069,483 | A | 1/1978 | Kaloi |
| 4,123,756 | A | 10/1978 | Nagata et al. |
| 4,123,758 | A | 10/1978 | Shibano et al. |
| 4,131,893 | A | 12/1978 | Munson et al. |
| 4,201,960 | A | 5/1980 | Skutta et al. |
| 4,255,729 | A | 3/1981 | Fukasawa et al. |
| 4,313,121 | A | 1/1982 | Campbell et al. |
| 4,356,492 | A | 10/1982 | Kaloi |
| 4,370,657 | A | 1/1983 | Kaloi |
| 4,423,396 | A | 12/1983 | Makimoto et al. |
| 4,431,977 | A | 2/1984 | Sokola et al. |
| 4,546,357 | A | 10/1985 | Laughon et al. |
| 4,559,508 | A | 12/1985 | Nishikawa et al. |
| 4,625,212 | A | 11/1986 | Oda et al. |
| 4,652,889 | A | 3/1987 | Bizouard et al. |
| 4,661,992 | A | 4/1987 | Garay et al. |
| 4,692,726 | A | 9/1987 | Green et al. |
| 4,703,291 | A | 10/1987 | Nishikawa et al. |
| 4,706,050 | A | 11/1987 | Andrews |
| 4,716,391 | A | 12/1987 | Moutrie et al. |
| 4,740,765 | A | 4/1988 | Ishikawa et al. |
| 4,742,562 | A | 5/1988 | Kommrusch |
| 4,761,624 | A | 8/1988 | Igarashi et al. |
| 4,800,348 | A | 1/1989 | Rosar et al. |
| 4,800,392 | A | 1/1989 | Garay et al. |
| 4,821,006 | A | 4/1989 | Ishikawa et al. |
| 4,823,098 | A | 4/1989 | DeMuro et al. |
| 4,827,266 | A | 5/1989 | Sato et al. |
| 4,829,274 | A | 5/1989 | Green et al. |
| 4,862,181 | A | 8/1989 | PonceDeLeon et al. |
| 4,879,533 | A | 11/1989 | De Muro et al. |
| 4,896,124 | A | 1/1990 | Schwent |
| 4,954,796 | A | 9/1990 | Green et al. |
| 4,965,537 | A | 10/1990 | Kommrusch |
| 4,977,383 | A | 12/1990 | Niiranen |
| 4,980,694 | A | 12/1990 | Hines |
| 5,017,932 | A | 5/1991 | Ushiyama et al. |
| 5,047,739 | A | 9/1991 | Kuokkanene |
| 5,053,786 | A | 10/1991 | Silverman et al. |
| 5,097,236 | A | 3/1992 | Wakino et al. |
| 5,103,197 | A | 4/1992 | Turunen |
| 5,109,536 | A | 4/1992 | Kommrusch |
| 5,155,493 | A | 10/1992 | Thursby et al. |
| 5,157,363 | A | 10/1992 | Puurunen |
| 5,159,303 | A | 10/1992 | Flink |
| 5,166,697 | A | 11/1992 | Viladevall et al. |
| 5,170,173 | A | 12/1992 | Krenz et al. |
| 5,203,021 | A | 4/1993 | Repplinger et al. |
| 5,210,510 | A | 5/1993 | Karsikas |
| 5,210,542 | A | 5/1993 | Pett et al. |
| 5,220,335 | A | 6/1993 | Huang |
| 5,229,777 | A | 7/1993 | Doyle |
| 5,239,279 | A | 8/1993 | Turunen |
| 5,278,528 | A | 1/1994 | Turunen |
| 5,281,326 | A | 1/1994 | Galla |
| 5,298,873 | A | 3/1994 | Ala-Kojola |
| 5,302,924 | A | 4/1994 | Jantunen |
| 5,304,968 | A | 4/1994 | Ohtonen |
| 5,307,036 | A | 4/1994 | Turunen |
| 5,319,328 | A | 6/1994 | Turunen |
| 5,349,315 | A | 9/1994 | Ala-Kojola |
| 5,349,700 | A | 9/1994 | Parker |
| 5,351,023 | A | 9/1994 | Niiranen |
| 5,354,463 | A | 10/1994 | Turunen |
| 5,355,142 | A | 10/1994 | Marshall et al. |
| 5,357,262 | A | 10/1994 | Blaese |
| 5,363,114 | A | 11/1994 | Shoemaker |
| 5,369,782 | A | 11/1994 | Kawano et al. |
| 5,382,959 | A | 1/1995 | Pett et al. |
| 5,386,214 | A | 1/1995 | Sugawara |
| 5,387,886 | A | 2/1995 | Takalo |
| 5,394,162 | A | 2/1995 | Korovesis et al. |
| RE34,898 | E | 4/1995 | Turunen et al. |
| 5,408,206 | A | 4/1995 | Turunen |
| 5,418,508 | A | 5/1995 | Puurunen |
| 5,432,489 | A | 7/1995 | Yrjola |
| 5,438,697 | A | 8/1995 | Fowler et al. |
| 5,440,315 | A | 8/1995 | Wright et al. |
| 5,442,280 | A | 8/1995 | Baudart |
| 5,442,366 | A | 8/1995 | Sanford |
| 5,444,453 | A | 8/1995 | Lalezari |
| 5,467,065 | A | 11/1995 | Turunen |
| 5,473,295 | A | 12/1995 | Turunen |
| 5,506,554 | A | 4/1996 | Ala-Kojola |
| 5,508,668 | A | 4/1996 | Prokkola |
| 5,517,683 | A | 5/1996 | Collett et al. |
| 5,521,561 | A | 5/1996 | Yrjola |
| 5,532,703 | A | 7/1996 | Stephens et al. |
| 5,541,560 | A | 7/1996 | Turunen |
| 5,541,617 | A | 7/1996 | Connolly et al. |
| 5,543,764 | A | 8/1996 | Turunen |
| 5,550,519 | A | 8/1996 | Korpela |
| 5,557,287 | A | 9/1996 | Pottala et al. |
| 5,557,292 | A | 9/1996 | Nygren et al. |
| 5,570,071 | A | 10/1996 | Ervasti |
| 5,585,771 | A | 12/1996 | Ervasti |
| 5,585,810 | A | 12/1996 | Tsuru et al. |
| 5,589,844 | A | 12/1996 | Belcher et al. |
| 5,594,395 | A | 1/1997 | Niiranen |
| 5,604,471 | A | 2/1997 | Rattila |
| 5,627,502 | A | 5/1997 | Ervasti |
| 5,649,316 | A | 7/1997 | Prudhomme et al. |
| 5,668,561 | A | 9/1997 | Perrotta et al. |
| 5,675,301 | A | 10/1997 | Nappa |
| 5,689,221 | A | 11/1997 | Niiranen |
| 5,694,135 | A | 12/1997 | Dikun et al. |
| 5,703,600 | A | 12/1997 | Burrell et al. |
| 5,709,832 | A | 1/1998 | Hayes et al. |
| 5,711,014 | A | 1/1998 | Crowley et al. |
| 5,717,368 | A | 2/1998 | Niiranen |
| 5,731,749 | A | 3/1998 | Yrjola |
| 5,734,305 | A | 3/1998 | Ervasti |
| 5,734,350 | A | 3/1998 | Deming et al. |
| 5,734,351 | A | 3/1998 | Ojantakanen |
| 5,739,735 | A | 4/1998 | Pyykko |
| 5,742,259 | A | 4/1998 | Annamaa |
| 5,757,327 | A | 5/1998 | Yajima et al. |
| 5,764,190 | A | 6/1998 | Murch et al. |
| 5,767,809 | A | 6/1998 | Chuang et al. |
| 5,768,217 | A | 6/1998 | Sonoda et al. |
| 5,777,581 | A | 7/1998 | Lilly et al. |
| 5,777,585 | A | 7/1998 | Tsuda et al. |
| 5,793,269 | A | 8/1998 | Ervasti |
| 5,812,094 | A | 9/1998 | Maldonado |
| 5,815,048 | A | 9/1998 | Ala-Kojola |
| 5,822,705 | A | 10/1998 | Lehtola |
| 5,852,421 | A | 12/1998 | Maldonado |
| 5,861,854 | A | 1/1999 | Kawahata et al. |
| 5,874,926 | A | 2/1999 | Tsuru et al. |
| 5,880,697 | A | 3/1999 | McCarrick et al. |
| 5,886,668 | A | 3/1999 | Pedersen et al. |
| 5,892,490 | A | 4/1999 | Asakura et al. |
| 5,903,820 | A | 5/1999 | Hagstrom |
| 5,905,475 | A | 5/1999 | Annamaa |
| 5,920,290 | A | 7/1999 | McDonough et al. |
| 5,926,139 | A | 7/1999 | Korisch |
| 5,929,813 | A | 7/1999 | Eggleston |
| 5,936,583 | A | 8/1999 | Sekine et al. |
| 5,943,016 | A | 8/1999 | Snyder, Jr. et al. |
| 5,952,975 | A | 9/1999 | Pedersen et al. |
| 5,959,583 | A | 9/1999 | Funk |
| 5,963,180 | A | 10/1999 | Leisten |
| 5,966,097 | A | 10/1999 | Fukasawa et al. |
| 5,970,393 | A | 10/1999 | Khorrami et al. |
| 5,977,710 | A | 11/1999 | Kuramoto et al. |
| 5,986,606 | A | 11/1999 | Kossiavas et al. |
| 5,986,608 | A | 11/1999 | Korisch et al. |
| 5,990,848 | A | 11/1999 | Annamaa |
| 5,999,132 | A | 12/1999 | Kitchener et al. |

6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,034,640 A * 3/2000 Oida et al. ..... 343/722
6,037,848 A 3/2000 Alila
6,043,780 A 3/2000 Funk et al.
6,072,434 A 6/2000 Papatheodorou
6,078,231 A 6/2000 Pelkonen
6,091,363 A 7/2000 Komatsu et al.
6,097,345 A 8/2000 Walton
6,100,849 A 8/2000 Tsubaki et al.
6,112,106 A 8/2000 Crowley et al.
6,133,879 A 10/2000 Grangeat et al.
6,134,421 A 10/2000 Lee et al.
6,140,973 A 10/2000 Annamaa
6,147,650 A 11/2000 Kawahata et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,246,368 B1 6/2001 Deming et al.
6,252,552 B1 6/2001 Tarvas et al.
6,252,554 B1 6/2001 Isohatala et al.
6,255,994 B1 7/2001 Saito
6,259,029 B1 7/2001 Hand
6,268,831 B1 7/2001 Sanford
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki et al.
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham
6,423,915 B1 7/2002 Winter
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tseng et al.
6,462,716 B1 10/2002 Kushihi
6,469,673 B2 10/2002 Kaiponen
6,473,056 B2 10/2002 Annamaa
6,476,769 B1 11/2002 Lehtola
6,480,155 B1 11/2002 Eggleston
6,501,425 B1 12/2002 Nagumo
6,518,925 B1 2/2003 Annamaa
6,529,168 B2 3/2003 Mikkola
6,535,170 B2 3/2003 Sawamura
6,538,604 B1 3/2003 Isohatala
6,549,167 B1 4/2003 Yoon
6,556,812 B1 4/2003 Pennanen et al.
6,566,944 B1 5/2003 Pehlke et al.
6,580,396 B2 6/2003 Lin
6,580,397 B2 6/2003 Lindell
6,600,449 B2 7/2003 Onaka
6,603,430 B1 8/2003 Hill et al.
6,606,016 B2 8/2003 Takamine
6,611,235 B2 8/2003 Barna et al.
6,614,400 B2 9/2003 Egorov
6,614,405 B1 9/2003 Mikkonen
6,634,564 B2 10/2003 Kuramochi
6,636,181 B2 10/2003 Asano
6,639,564 B2 10/2003 Johnson
6,646,606 B2 11/2003 Mikkola
6,650,295 B2 * 11/2003 Ollikainen et al. .... 343/700 MS
6,657,593 B2 12/2003 Nagumo et al.
6,657,595 B1 12/2003 Alameh et al.
6,670,926 B2 12/2003 Miyasaka
6,677,903 B2 1/2004 Wang
6,683,573 B2 1/2004 Park
6,693,594 B2 2/2004 Pankinaho et al.
6,717,551 B1 4/2004 Desclos et al.
6,727,857 B2 4/2004 Mikkola et al.
6,734,825 B1 5/2004 Guo et al.
6,734,826 B1 5/2004 Dai et al.
6,738,022 B2 5/2004 Klaavo et al.
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 11/2004 Sullivan et al.
6,819,293 B2 11/2004 De Graauw
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi et al.
6,897,810 B2 5/2005 Dai et al.
6,900,768 B2 5/2005 Iguchi et al.
6,903,692 B2 6/2005 Kivekas
6,911,945 B2 6/2005 Korva
6,922,171 B2 7/2005 Annamaa et al.
6,925,689 B2 8/2005 Folkmar
6,927,792 B1 8/2005 Mimura et al.
6,937,196 B2 8/2005 Korva
6,950,066 B2 9/2005 Hendler et al.
6,950,068 B2 9/2005 Bordi
6,952,144 B2 10/2005 Javor
6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita et al.
6,967,618 B2 11/2005 Ojantakanen et al.
6,975,278 B2 12/2005 Song et al.
6,985,108 B2 1/2006 Mikkola
6,992,543 B2 1/2006 Luetzelschwab et al.
6,995,710 B2 2/2006 Sugimoto et al.
7,023,341 B2 4/2006 Stilp
7,031,744 B2 4/2006 Kuriyama et al.
7,042,403 B2 5/2006 Colburn et al.
7,053,841 B2 5/2006 Ponce De Leon et al.
7,054,671 B2 5/2006 Kaiponen et al.
7,057,560 B2 6/2006 Erkocevic
7,081,857 B2 7/2006 Kinnunen et al.
7,084,831 B2 8/2006 Takagi et al.
7,099,690 B2 * 8/2006 Milosavljevic ..... 455/552.1
7,113,133 B2 9/2006 Chen et al.
7,119,749 B2 10/2006 Miyata et al.
7,126,546 B2 10/2006 Annamaa et al.
7,136,019 B2 11/2006 Mikkola et al.
7,136,020 B2 11/2006 Yamaki
7,142,824 B2 11/2006 Kojima et al.
7,148,847 B2 12/2006 Yuanzhu
7,148,849 B2 12/2006 Lin
7,148,851 B2 12/2006 Takaki et al.
7,170,464 B2 1/2007 Tang et al.

| | | | |
|---|---|---|---|
| 7,176,838 | B1 | 2/2007 | Kinezos |
| 7,180,455 | B2 | 2/2007 | Oh et al. |
| 7,193,574 | B2 | 3/2007 | Chiang et al. |
| 7,205,942 | B2 | 4/2007 | Wang et al. |
| 7,218,280 | B2 | 5/2007 | Annamaa et al. |
| 7,218,282 | B2 | 5/2007 | Humpfer et al. |
| 7,224,313 | B2 | 5/2007 | McKinzie, III et al. |
| 7,230,574 | B2 | 6/2007 | Johnson |
| 7,237,318 | B2 | 7/2007 | Annamaa |
| 7,256,743 | B2 | 8/2007 | Korva |
| 7,274,334 | B2 | 9/2007 | O'Riordan et al. |
| 7,283,097 | B2 | 10/2007 | Wen et al. |
| 7,289,064 | B2 | 10/2007 | Cheng |
| 7,292,200 | B2 | 11/2007 | Posluszny et al. |
| 7,319,432 | B2 | 1/2008 | Andersson |
| 7,330,153 | B2 | 2/2008 | Rentz |
| 7,333,067 | B2 | 2/2008 | Hung et al. |
| 7,339,528 | B2 | 3/2008 | Wang et al. |
| 7,340,286 | B2 | 3/2008 | Korva et al. |
| 7,345,634 | B2 | 3/2008 | Ozkar et al. |
| 7,352,326 | B2 | 4/2008 | Korva |
| 7,358,902 | B2 | 4/2008 | Erkocevic |
| 7,382,319 | B2 | 6/2008 | Kawahata et al. |
| 7,385,556 | B2 | 6/2008 | Chung et al. |
| 7,388,543 | B2 | 6/2008 | Vance |
| 7,391,378 | B2 | 6/2008 | Mikkola |
| 7,405,702 | B2 | 7/2008 | Annamaa et al. |
| 7,417,588 | B2 | 8/2008 | Castany et al. |
| 7,423,592 | B2 | 9/2008 | Pros et al. |
| 7,432,860 | B2 | 10/2008 | Huynh |
| 7,439,929 | B2 | 10/2008 | Ozkar |
| 7,468,700 | B2 * | 12/2008 | Milosavlejevic ..... 343/702 |
| 7,468,709 | B2 | 12/2008 | Niemi |
| 7,498,990 | B2 | 3/2009 | Park et al. |
| 7,501,983 | B2 | 3/2009 | Mikkola |
| 7,502,598 | B2 | 3/2009 | Kronberger |
| 7,589,678 | B2 | 9/2009 | Perunka |
| 7,616,158 | B2 | 11/2009 | Mark et al. |
| 7,633,449 | B2 | 12/2009 | Oh |
| 7,663,551 | B2 | 2/2010 | Nissinen |
| 7,679,565 | B2 | 3/2010 | Sorvala |
| 7,692,543 | B2 | 4/2010 | Copeland |
| 7,710,325 | B2 | 5/2010 | Cheng |
| 7,724,204 | B2 | 5/2010 | Annamaa |
| 7,760,146 | B2 | 7/2010 | Ollikainen |
| 7,764,245 | B2 | 7/2010 | Loyet |
| 7,786,938 | B2 | 8/2010 | Sorvala |
| 7,800,544 | B2 | 9/2010 | Thornell-Pers |
| 7,830,327 | B2 | 11/2010 | He |
| 7,889,139 | B2 | 2/2011 | Hobson et al. |
| 7,889,143 | B2 | 2/2011 | Milosavljevic |
| 7,901,617 | B2 | 3/2011 | Taylor |
| 7,916,086 | B2 | 3/2011 | Koskiniemi et al. |
| 7,963,347 | B2 | 6/2011 | Pabon |
| 7,973,720 | B2 | 7/2011 | Sorvala |
| 8,049,670 | B2 | 11/2011 | Jung et al. |
| 8,179,322 | B2 | 5/2012 | Nissinen |
| 2001/0050636 | A1 | 12/2001 | Weinberger |
| 2002/0183013 | A1 | 12/2002 | Auckland et al. |
| 2002/0196192 | A1 | 12/2002 | Nagumo et al. |
| 2003/0146873 | A1 | 8/2003 | Blancho |
| 2004/0090378 | A1 | 5/2004 | Dai et al. |
| 2004/0145525 | A1 | 7/2004 | Annabi et al. |
| 2004/0171403 | A1 | 9/2004 | Mikkola |
| 2005/0057401 | A1 | 3/2005 | Yuanzhu |
| 2005/0159131 | A1 | 7/2005 | Shibagaki et al. |
| 2005/0176481 | A1 | 8/2005 | Jeong |
| 2006/0071857 | A1 | 4/2006 | Pelzer |
| 2007/0042615 | A1 | 2/2007 | Liao |
| 2007/0082789 | A1 | 4/2007 | Nissila |
| 2007/0152881 | A1 | 7/2007 | Chan |
| 2008/0055164 | A1 | 3/2008 | Zhang et al. |
| 2008/0059106 | A1 | 3/2008 | Wight |
| 2008/0088511 | A1 | 4/2008 | Sorvala |
| 2008/0266199 | A1 | 10/2008 | Milosavljevic |
| 2009/0009415 | A1 | 1/2009 | Tanska |
| 2009/0135066 | A1 | 5/2009 | Raappana et al. |
| 2009/0174604 | A1 | 7/2009 | Keskitalo |
| 2009/0196160 | A1 | 8/2009 | Crombach |
| 2010/0220016 | A1 | 9/2010 | Nissinen |
| 2010/0244978 | A1 | 9/2010 | Milosavljevic |
| 2010/0309092 | A1 | 12/2010 | Lambacka |
| 2011/0102290 | A1 | 5/2011 | Milosavljevic |
| 2011/0133994 | A1 | 6/2011 | Korva |
| 2012/0119955 | A1 | 5/2012 | Milosavljevic |

FOREIGN PATENT DOCUMENTS

| | | | |
|---|---|---|---|
| DE | 10104862 | | 8/2002 |
| DE | 101 50 149 | A1 | 4/2003 |
| EP | 0208424 | | 1/1987 |
| EP | 0278069 | | 8/1988 |
| EP | 0279050 | | 8/1988 |
| EP | 0339822 | | 3/1989 |
| EP | 0 332 139 | | 9/1989 |
| EP | 0 376 643 | A2 | 4/1990 |
| EP | 0383292 | | 8/1990 |
| EP | 0399975 | | 12/1990 |
| EP | 0400872 | | 12/1990 |
| EP | 0401839 | | 9/1991 |
| EP | 0447218 | | 9/1994 |
| EP | 0615285 | | 10/1994 |
| EP | 0621653 | | 2/1995 |
| EP | 0 749 214 | | 12/1996 |
| EP | 0637094 | | 1/1997 |
| EP | 0 759 646 | A1 | 2/1997 |
| EP | 0 766 341 | | 2/1997 |
| EP | 0 766 340 | | 4/1997 |
| EP | 0751043 | | 4/1997 |
| EP | 0807988 | | 11/1997 |
| EP | 0 831 547 | A2 | 3/1998 |
| EP | 0851530 | | 7/1998 |
| EP | 0856907 | | 8/1998 |
| EP | 1 294 048 | | 1/1999 |
| EP | 0892459 | | 1/1999 |
| EP | 0766339 | | 2/1999 |
| EP | 0 942 488 | A2 | 9/1999 |
| EP | 1 003 240 | A2 | 5/2000 |
| EP | 1006605 | | 6/2000 |
| EP | 1006606 | | 6/2000 |
| EP | 1014487 | | 6/2000 |
| EP | 1024553 | | 8/2000 |
| EP | 1026774 | | 8/2000 |
| EP | 0999807 | | 10/2000 |
| EP | 1 052 723 | | 11/2000 |
| EP | 1052722 | | 11/2000 |
| EP | 1052723 | A2 | 11/2000 |
| EP | 1 063 722 | A2 | 12/2000 |
| EP | 1067627 | | 1/2001 |
| EP | 1094545 | | 4/2001 |
| EP | 1 102 348 | | 5/2001 |
| EP | 1098387 | | 5/2001 |
| EP | 1 113 524 | | 7/2001 |
| EP | 1113524 | A2 | 7/2001 |
| EP | 1 128 466 | A2 | 8/2001 |
| EP | 1 139 490 | | 10/2001 |
| EP | 1 146 589 | | 10/2001 |
| EP | 1 162 688 | | 12/2001 |
| EP | 1162688 | | 12/2001 |
| EP | 0993070 | | 4/2002 |
| EP | 1 248 316 | | 9/2002 |
| EP | 0923158 | | 9/2002 |
| EP | 1 267 441 | | 12/2002 |
| EP | 1271690 | | 1/2003 |
| EP | 1 294 049 | A1 | 3/2003 |
| EP | 1306922 | | 5/2003 |
| EP | 1 329 980 | | 7/2003 |
| EP | 1 351 334 | | 8/2003 |
| EP | 1 361 623 | | 11/2003 |
| EP | 1248316 | | 1/2004 |
| EP | 1396906 | | 3/2004 |
| EP | 1 406 345 | | 4/2004 |
| EP | 1 414 108 | | 4/2004 |
| EP | 1 432 072 | | 6/2004 |
| EP | 1 437 793 | | 7/2004 |
| EP | 1439603 | | 7/2004 |
| EP | 1 445 822 | | 8/2004 |

(56) References Cited

FOREIGN PATENT DOCUMENTS

| | | | |
|---|---|---|---|
| EP | 1 453 137 | | 9/2004 |
| EP | 1 469 549 | | 10/2004 |
| EP | 1220456 | | 10/2004 |
| EP | 1467456 | | 10/2004 |
| EP | 1469549 | A1 | 10/2004 |
| EP | 1 482 592 | | 12/2004 |
| EP | 1 498 984 | | 1/2005 |
| EP | 1 564 839 | | 1/2005 |
| EP | 1498984 | A1 | 1/2005 |
| EP | 1170822 | | 4/2005 |
| EP | 1 544 943 | | 6/2005 |
| EP | 1753079 | | 2/2007 |
| EP | 1 791 213 | | 5/2007 |
| EP | 1843432 | | 10/2007 |
| FI | 20020829 | | 11/2003 |
| FR | 2553584 | | 10/1983 |
| FR | 2873247 | | 1/2006 |
| GB | 2266997 | | 11/1993 |
| GB | 2 360 422 | A | 9/2001 |
| GB | 239246 | | 12/2003 |
| JP | 59202831 | | 11/1984 |
| JP | 600206304 | | 10/1985 |
| JP | 61245704 | | 11/1986 |
| JP | 06152463 | | 5/1994 |
| JP | 7131234 | | 5/1995 |
| JP | 7221536 | | 8/1995 |
| JP | 7249923 | | 9/1995 |
| JP | 07307612 | | 11/1995 |
| JP | 08216571 | | 8/1996 |
| JP | 09083242 | | 3/1997 |
| JP | 9260934 | | 10/1997 |
| JP | 9307344 | | 11/1997 |
| JP | 10028013 | A | 1/1998 |
| JP | 10107671 | | 4/1998 |
| JP | 10173423 | | 6/1998 |
| JP | 10 209733 | | 8/1998 |
| JP | 10224142 | | 8/1998 |
| JP | 10 327011 | | 12/1998 |
| JP | 10322124 | | 12/1998 |
| JP | 11 004117 | | 1/1999 |
| JP | 114113 | | 1/1999 |
| JP | 11 068456 | | 3/1999 |
| JP | 11127010 | | 5/1999 |
| JP | 11127014 | | 5/1999 |
| JP | 11136025 | | 5/1999 |
| JP | 11 355033 | | 12/1999 |
| JP | 2000278028 | | 10/2000 |
| JP | 200153543 | | 2/2001 |
| JP | 2001267833 | | 9/2001 |
| JP | 2001217631 | | 10/2001 |
| JP | 2001326513 | | 11/2001 |
| JP | 2002319811 | A | 10/2002 |
| JP | 2002329541 | | 11/2002 |
| JP | 2002335117 | | 11/2002 |
| JP | 200360417 | | 2/2003 |
| JP | 2003124730 | | 4/2003 |
| JP | 2003179426 | | 6/2003 |
| JP | 2003318638 | | 11/2003 |
| JP | 2004112028 | | 4/2004 |
| JP | 2004363859 | | 12/2004 |
| JP | 2005005985 | | 1/2005 |
| JP | 2005252661 | | 9/2005 |
| KR | 20010080521 | | 10/2001 |
| KR | 10-2006-7027462 | | 12/2002 |
| KR | 20020096016 | | 12/2002 |
| SE | 511900 | | 12/1999 |
| WO | WO 92/00635 | | 1/1992 |
| WO | WO 96/27219 | | 9/1996 |
| WO | WO 98/01919 | | 1/1998 |
| WO | WO 98/01921 | | 1/1998 |
| WO | WO 98/37592 | | 8/1998 |
| WO | WO 99/30479 | | 6/1999 |
| WO | WO 00/36700 | | 6/2000 |
| WO | WO 01/20718 | | 3/2001 |
| WO | WO 01/24316 | | 4/2001 |
| WO | WO 01/28035 | | 4/2001 |
| WO | WO 01/29927 | | 4/2001 |
| WO | WO 01/33665 | | 5/2001 |
| WO | WO 01/61781 | | 8/2001 |
| WO | WO 01/91236 | | 11/2001 |
| WO | WO 02/08672 | | 1/2002 |
| WO | WO 02/11236 | A1 | 2/2002 |
| WO | WO 02/13307 | | 2/2002 |
| WO | WO 02/41443 | | 5/2002 |
| WO | WO 02/067375 | | 8/2002 |
| WO | WO 02/078123 | | 10/2002 |
| WO | WO 02/078124 | | 10/2002 |
| WO | WO 03/094290 | | 11/2003 |
| WO | WO 2004/017462 | | 2/2004 |
| WO | WO 2004/036778 | | 4/2004 |
| WO | WO 2004/057697 | | 7/2004 |
| WO | WO 2004/070872 | | 8/2004 |
| WO | 2004100313 | A1 | 11/2004 |
| WO | WO 2004/112189 | A | 12/2004 |
| WO | WO 2005/011055 | | 2/2005 |
| WO | WO 2005/018045 | | 2/2005 |
| WO | WO 2005/034286 | | 4/2005 |
| WO | WO 2005/038981 | A1 | 4/2005 |
| WO | WO 2005/055364 | | 6/2005 |
| WO | WO 2005/062416 | | 7/2005 |
| WO | WO 2006/000631 | A1 | 1/2006 |
| WO | WO 2006/000650 | | 1/2006 |
| WO | WO 2006/051160 | A1 | 5/2006 |
| WO | WO 2006/084951 | A1 | 8/2006 |
| WO | WO 2006/097567 | | 9/2006 |
| WO | WO 2007/000483 | | 1/2007 |
| WO | WO 2007/000483 | A1 | 1/2007 |
| WO | WO 2007/012697 | | 2/2007 |
| WO | WO 2007/039667 | | 4/2007 |
| WO | WO 2007/039668 | | 4/2007 |
| WO | WO 2007/042614 | | 4/2007 |
| WO | WO 2007/042615 | | 4/2007 |
| WO | WO 2007/050600 | | 5/2007 |
| WO | WO 2007/080214 | | 7/2007 |
| WO | WO 2007/098810 | | 9/2007 |
| WO | WO 2007/138157 | | 12/2007 |
| WO | WO 2008/059106 | | 3/2008 |
| WO | WO 2008/129125 | | 10/2008 |
| WO | WO 2009/027579 | | 5/2009 |
| WO | WO 2009/095531 | | 8/2009 |
| WO | WO 2009/106682 | | 9/2009 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. And M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFa suitable for dual frequency 900/1800-MHz operation," *IEEE Trans. Antennas Propag.*, vol. 46, No. 4, pp. 596-598, Apr. 1998.

Cheng- Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EP 04 396 001.2-1248.

Examination Report dated May 3, 2006 issued by the EPO for European Patent Application No. 04 396 079.8.

(56) References Cited

OTHER PUBLICATIONS

F.R. Hsiao, et al. "A dual-band planar inverted-F patch antenna with a branch-line slit," *Microwave Opt. Technol. Lett.*, vol. 32, Feb. 20, 2002.
Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.
Guo, Y. X. and H. S. Tan, "New compact six-band internal antenna," *IEEE Antennas and Wireless Propagation Letters*, vol. 3, 295-297, 2004.
Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.
Hoon Park, et al. "Design of an Internal antenna with wide and multiband characteristics for a mobile handset", *IEEE Microw. & Opt. Tech. Lett.* vol. 48, No. 5, May 2006.
Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar., 2006.
Hossa, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.
I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.
International Preliminary Report on Patentability for International Application No. PCT/F12004/000554, date of issuance of report May 1, 2006.
Jing, X., et al.; "Compact Planar Monopole Antenna for Multi-Band Mobile Phones"; Microwave Conference Proceedings, 4.-7.12.2005. APMC 2005, Asia- Pacific Conference Proceedings, vol. 4.
Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.
K-L Wong, *Planar Antennas for Wireless Communications*., Hoboken, NJ: Willey, 2003, ch. 2.
Lindberg., P. And E. Ojefors, "A bandwidth enhancement technique for mobile handset antennas using wavetraps," *IEEE Transactions on Antennas and Prepagation*, vol. 54, 2226{2232, 2006.
Marta Martinez- Vazquez, et al "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and Wlan Standards", *Electronic Letters*, vol. 40, No. 15, pp. 920-921, Jul. 2004.
P. Ciais, R. Staraj, 0, Kossiavas, and C. Luxey, "Design of an internal quadband antenna for mobile phones", *IEEE Microwave Wireless Comp. Lett.*, vol. 14, No. 4, pp. 148-150, Apr., 2004.
P. Salonen, et al. "New slot configurations for dual-band planar inverted-F antenna," *Microwave Opt. Technol.*, vol. 28, pp. 293-298, 2001.
Papapolyrnerou, loannis et al., "Micromachined Patch Antennas", IEEE Transactions on Antennas and Propagation, vol. 46, No. 2, pp. 275-283, Feb. 1998.
Product of the Month, RFDesign, "GSM/CPRS Quad Band Power Amp Includes Antenna Switch," 1 page, reprinted 11/04 issue of RF Design (www.rfdesign.com), Copyright 2004, Freescale Semiconductor, RFD-24-EK.
S. Tarvas, et al. "An internal dual-band mobile phone antenna," in *2000 IEEE Antennas Propagat. Soc. Int. Symp. Dig.*, pp. 266-269, Salt Lake City, UT, USA.
Wang, F., Z. Du, Q. Wang, and K. Gong, "Enhanced-bandwidth PIFA with T-shaped ground plane," Electronics Letters, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi Kumar, et al. "Broadband Concentric Rings Fractal Slot Antenna," Department of Electrical Engineering, Indian Institute of Technology, Kanpur-208 016, India.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "*Investigation of Low Profile Antenna Designs for Use in Hand-Held Radios*,"Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun YetSen University, 2002 09 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.

* cited by examiner

ADJUSTABLE MULTIBAND ANTENNA AND METHODS

PRIORITY AND RELATED APPLICATIONS

This application claims priority to International PCT Application No. PCT/FI2006/050341 having an international filing date of Jul. 13, 2006, which claims priority to Finland Patent Application No. 20055420 filed Jul. 25, 2005, each of the foregoing incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

The invention relates to an adjustable multiband antenna especially applicable in mobile terminals. The invention further relates to a radio device equipped with such an antenna.

The adjustability of an antenna means in this description, that a resonance frequency or frequencies of the antenna can be changed electrically. The aim is that the operating band of the antenna around a resonance frequency always covers the frequency range, which the function presumes at each time. There are different causes for the need for adjustability. As portable radio devices, like mobile terminals, are becoming smaller thickness-wise, too, the distance between the radiating plane and the ground plane of an internal planar antenna unavoidably becomes shorter. This results in e.g. that the antenna bandwidths will decrease. Then, as a mobile terminal is intended for operating in a plurality of radio systems having frequency ranges relatively close to each other, it becomes more difficult or impossible to cover frequency ranges used by more than one radio system. Such a system pair is for instance GSM1800 and GSM1900 (Global System for Mobile telecommunications). Correspondingly, securing the function that conforms to specifications in both transmitting and receiving bands of a single system can become more difficult. If the system uses sub-band division, it is advantageous if the resonance frequency of the antenna can be tuned in a sub-band being used at each time, from the point of view of the radio connection quality.

In the invention described here the antenna adjusting is implemented by a switch. The use of switches for the purpose in question is well known as such. For example the publication EP1113 524 discloses an antenna, where a planar radiator can at a certain point be connected to the ground by a switch. When the switch is closed, the electric length of the radiator is decreased, in which case the antenna resonance frequency becomes higher and the operating band corresponding to the resonance frequency is displaced upwards. A capacitor can be in series with the switch to set the band displacement as large as desired. The solution is suitable for single-band antennas. The controlled displacement of the operating bands of a multi-band antenna is impossible.

In FIG. 1 there is a solution including a switch, known from the publication EP 04008490.7. Of the antenna base structure, only a part of the radiating plane 120 is drawn in the figure. The antenna has two separate operating bands. The antenna comprises, in addition to the base structure, an adjusting circuit having a parasitic element 131, a filter 132, a two-way switch 133, a terminating element 138 and transmission lines. The parasitic element has a significant electromagnetic coupling to the radiating plane and is connected through a short transmission line to the input port of the filter 132. Each transmission line comprises a ground conductor and a separate conductor. The output port of the filter is connected through the second short transmission line to the switch 133, the "hot" pole of the output port to the common pole of the switch by the separate conductor of the second transmission line. The common pole of the switch can be connected either to the second or the third pole of the switch by controlling the switch. The second pole of the switch is connected fixedly to the separate conductor 134 of the third short transmission line, which line is open at its opposite end. The third pole of the switch is connected fixedly to the separate conductor 135 of the fourth short transmission line. At the opposite end of the fourth transmission line there is a reactive terminating element 138. Its reactance X can be just a short-circuit (zero inductance). The impedance, which the adjusting circuit presents seen from the radiator, depends on the lengths of the transmission lines and the reactance X. The circuit can be designed so that the impedance of the adjusting circuit is very high when the common pole of the switch is connected to the third pole, and the impedance is suitable when the common pole is connected to the second pole. "Suitable" means a value, which causes the operating band to displace as much as desired when the state of the switch is changed.

The object of the filter 132 is to strict the effect of the switching only to one operating band. If it is desired that the effect is stricted e.g. to the upper operating band, the filter is made to be of high-pass type, and its cut-off frequency is arranged between the antenna operating bands. In this case the lower operating band is located in the stop band of the filter, and the impedance of the adjusting circuit at the frequencies of the lower operating band is high in both states of the switch. Changing the switch state then causes neither a change in the electric length of the antenna nor a displacement of the lower operating band.

In the solution according to FIG. 1 it is possible to affect a single operating band of a multi-band antenna without changing the place of the parasitic element used as a coupling element. However, the control of simultaneous displacements of two bands is impossible. In addition, it is difficult to keep the tolerances of the couplings between the paratisitic element and the radiators small enough in the production.

In FIG. 2 there is a solution including switches, known from the publication U.S. Pat. No. 6,650,295. The radiating plane 220 of a planar antenna is seen in the drawing. The radiating plane is located above the circuit board of a radio device, the conductive upper surface of the circuit board functioning as a ground plane 210 of the antenna and as a ground conductor of the transmission lines, which belong to the structure. The short-circuit conductor 211 and the feed conductor 212 of the antenna join to the radiating plane. Thus the antenna is of the PIFA type (Planar Inverted F-Antenna). In the radiating plane there is a non-conductive slot 225 starting from its edge, which slot divides the plane, as viewed from its short-circuit point, to two branches having different lengths. The PIFA is then a dual-band antenna. The lower operating band is based on the longer branch 221 and the upper operating band on the shorter branch 222.

Both the lower and upper operation band can be displaced in the structure according to FIG. 2. For the displacement of the lower operation band there is the first adjusting circuit 230 and for the displacement of the upper operation band the second adjusting circuit 240. The first adjusting circuit 230 comprises a first transmission line, a first switch 232 and two extension lines. The first transmission line is longer than the extension lines. The separate conductor 231 of the first transmission line joins the edge of the radiating plane at a point of its longer branch 221. The second end of the separate conductor 231 is connected to the common pole of the first switch 232. This switch has three states. In its first state the second end of the separate conductor 231 is switched to nothing, in the second state it is switched to the separate conductor 233 of the first extension line, and in the third state it is switched to the separate conductor 234 of the second extension line. Each extension line is shorted at its opposite end. They have different lengths, the longer branch of the radiating plane thus having three alternative electric lengths depending on the state of the switch 232, and correspondingly the lower operating band of the antenna having three alternative places. The second adjusting circuit 240 is similar to the first adjusting circuit. The separate conductor 241 of the fourth extension line, corresponding to the separate conductor 231 of the first transmission line, joins the edge of the radiating plane at such a point that the second adjusting circuit mainly affects solely the upper operating band. The place of the upper operating band can be selected from three alternatives by means of the second switch 242.

The lengths of the first and fourth transmission line are in the order of the quarter wave. If that length is shorter than the quarter wave, connecting a short extension line to its end results in that the band is displaced upwards, and if the length is longer than the quarter wave, connecting a short extension line to its end results in that the band is displaced downwards. The losses caused by the switch and thus the influence of the switch on the antenna efficiency depend on the length of the transmission line joining the radiating plane. That length and the lengths of the extension lines can be optimized so that the desired band displacements will be obtained at the cost of relatively small lowering of the antenna efficiency. The adjusting circuits further may comprise discrete tuning capacitors as an addition or replacing some transmission lines.

In the solution described above, the controlled displacement of two bands requires two adjusting circuits with their switches. This means a relatively complicated structure and high production costs.

SUMMARY OF THE INVENTION

In a first aspect of the invention, an adjusting circuit of an antenna, which has at least two operating bands is disclosed. In one embodiment, the adjusting circuit of an antenna is galvanically connected to a point of the radiator, where the circuit can affect the places of two antenna operating bands. The adjusting circuit comprises a multi-pole switch, by which said radiator point can be connected to one of alternative transmission lines. For example, one of the two transmission lines is open and another shorted. A discrete capacitor can be located between the separate conductor of the transmission line and an output pole of the switch as an additive tuning element. The adjusting circuit further comprises an LC circuit between the radiator and the switch. Among other things, the lengths of the transmission lines, the values of the discrete components and the distance between the antenna short-circuit point and the adjusting circuit connecting point then are variables from the point of view of the antenna adjusting. Such values are calculated for these variables that each of the two antenna operation bands separately shifts to a desired other place, when the switch state is changed.

An advantage of the invention is that desired displacements for the two antenna operation bands are obtained. One of the displacements can be set as zero, too. Another advantage of the invention is that these displacements can be implemented by a relatively simple adjusting circuit, which is connected to the radiator only at one point. A further advantage of the invention is that the space required for the antenna adjusting circuit is relatively small. This is due to that physically very short transmission lines are enough in the adjusting circuit according to the invention. A further advantage of the invention is that a relatively high efficiency is achieved for the antenna despite the use of a switch. A further advantage of the invention is that said LC circuit functions as an ESD protector (electro-static discharge) for the switch at the same time.

In an alternative, embodiment, the adjustable antenna comprises at least a lower and an upper operating band comprises a ground plane; a radiating plane; and an adjusting circuit for displacing at least one of said lower and upper operating bands. The adjusting circuit comprises an LC circuit with an input coupled to the radiating plane, a switch with its fixed end coupled to an output of the LC circuit and at least two tuning lines, the first of which is coupled to a first output pole of the switch and the second of said tuning lines coupled to a second output pole of the switch.

In one variant, the electric distance in the radiating plane between a grounding point and an adjusting point is arranged for desired displacements of the operating bands.

In another variant, the length of the tuning lines is at the most a fifth of the wavelength corresponding to the highest utilization frequency of the antenna.

In yet another variant, the first tuning line of the adjusting circuit is open at its tail end and the second tuning line is short-circuited at its tail end, and the adjusting circuit further comprises a capacitor connected between the second output pole of the switch and a separate conductor of the second tuning line.

In yet another variant, the radiating plane is coupled to the second tuning line, the adjusting circuit corresponds to a short-circuited transmission line with a quarter wavelength in the upper operating band, and the capacitance of the capacitor is arranged so that the adjusting circuit corresponds to a short-circuited transmission line with a zero length in the lower operating band, and when the radiator is connected to the first tuning line, the adjusting circuit corresponds to an open transmission line with a quarter wavelength in the upper operating band and the inductance of a coil of the LC circuit is arranged so that the adjusting circuit corresponds to an open transmission line with a zero length in the lower operating band.

In yet another variant, the first tuning line of the adjusting circuit is open at its tail end and the second tuning line is terminated by another coil at its tail end to keep the upper operating band in its place when the state of the switch changes.

In yet another variant the length of the tuning lines is less than a twentieth of the wavelength corresponding to the highest utilization frequency of the antenna.

In yet another variant, the number of the output poles of the switch is at least three to increase the number of alternative places of at least one operating band.

In yet another variant, the LC circuit comprises an ESD protector of the switch.

In yet another variant, the LC circuit is a low-pass filter limiting the effect of changing the switch state to the lower operating band.

In yet another variant, the LC circuit is a high-pass filter limiting the effect of changing the switch state to the upper operating band.

In a second aspect of the invention, a method of operating a multi-band adjustable antenna is disclosed. In one embodiment, the multi-band adjustable antenna comprises at least two operating bands and an adjusting circuit with the adjusting circuit comprising a switch, and the method comprises operating the multi-band adjustable antenna in a first state having at least first and second operating bands; switching the state of the switch; and operating the multi-band adjustable antenna in a second state having at least third and fourth operating bands.

In one variant, at least one of the operating bands comprises the GSM900 operating band.

In yet another variant, at least one of the one of the operating bands comprises the GSM1800 operating band.

In yet another variant, at least one of the operating bands comprises the GSM850 operating band.

In yet another variant, at least one of the operating bands comprises the GSM1900 operating band.

In a third aspect of the invention, apparatus incorporating the aforementioned antenna apparatus are disclosed. In one embodiment, the apparatus comprises a radio device, comprising: a radio transceiver circuit; and an adjustable multi-band antenna having at least a lower and an upper operating band, said antenna comprising: a ground plane; a radiating plane; and an adjusting circuit for displacing at least one of said lower and upper operating bands.

In one variant, the adjusting circuit comprises: an LC circuit with an input coupled to the radiating plane; a switch with its fixed end coupled to an output of the LC circuit; and at least two tuning lines, the first of which is coupled to a first output pole of the switch and the second of said tuning lines coupled to a second output pole of the switch.

BRIEF DESCRIPTION OF THE DRAWINGS

FIGS. 1 and 2 were already described in conjunction with the description of the prior art.

FIG. 3 shows an example of an antenna according to the invention as seen from above, or from the side of the radiating plane. The circuit board PCB of a radio device is seen below the radiating plane 320, the conductive upper surface of the circuit board functioning as a ground plane 310 of the antenna. The antenna short-circuit conductor joins the radiating plane at the short-circuit point, or the grounding point G, and the feed conductor joins the radiating plane at the feeding point F. In addition, a conductor of the antenna adjusting circuit joins the radiating plane at the adjusting point X. In this example the radiating plane is rectangular by outline, and all three points are located at its same long side, the feeding point being located closest to a corner and the grounding point being located therebetween. The radiating plane is shaped so that the antenna of the example is a dual-band antenna; it has a lower and an upper operating band. The lower operating band is based on the PIFA structure formed by the radiating plane, the ground plane and the feed and short-circuit conductors. The upper operating band is based on the slot radiator, which slot 322 starts at the edge of the radiating plane, beside the adjusting point X, on the farther side of the point X as seen from the grounding point G. The slot 322 ends in the inner area of the radiating plane near the opposite end of the plane as seen from the feeding point. The slot naturally affects the electric length of the lower operating band radiator 320 at the same time. In the radiating plane there is also an L-shaped slot starting between the feeding and short-circuit points, by which slot the antenna matching is improved both in the lower and the upper operating bands. In addition, the radiating plane has in this example two projections being directed towards the ground plane to tune the antenna and to improve its matching. One projection 328 is located at the end on the side of the feeding point, and the other projection 329 is located at the side of the grounding and adjusting points, from the open end of the slot radiator 322 towards the opposite end of the plane.

Based on the location of the adjusting point X, a circuit connected to it affects both the lower and the upper operating band. If the adjusting point were connected directly to the ground plane, for example, the electric length of the antenna parts corresponding to both the lower and the upper operating band would decrease, in which case both bands would shift upwards. The adjusting circuit connected to the adjusting point is located either below the radiating plane 320 or on the opposite side of the circuit board PCB.

Figure 1:
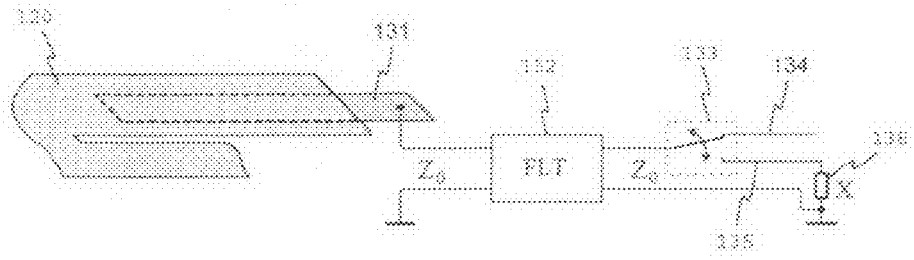
Fig. 1 PRIOR ART
FIG. 1 presents an example of an adjustable antenna according to the prior art.
Figure 2:
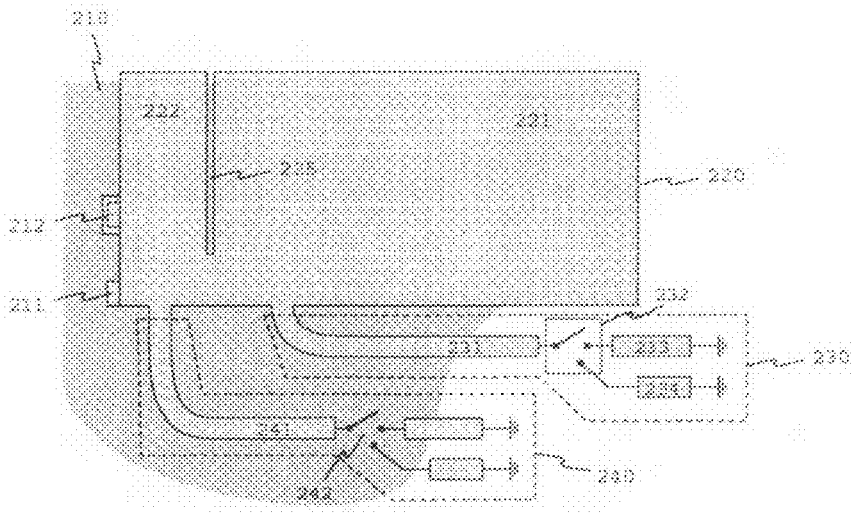
Fig. 2 PRIOR ART
FIG. 2 presents an second example of an adjustable antenna according to the prior art.
Figure 3:
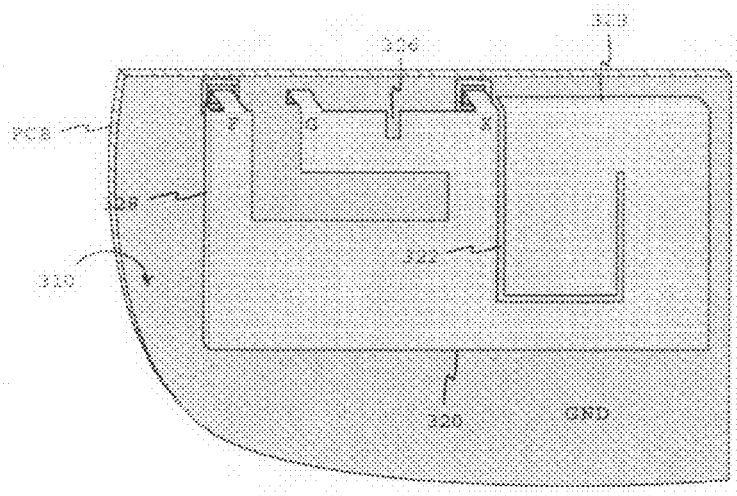
FIG. 3 presents an example of the radiating plane of an adjustable antenna according to the invention.

The electric distance between the grounding point G and the adjusting point X has a significant effect on how big the band displacements are when the adjusting circuit is controlled. In an antenna according to the invention, said distance is one variable in addition to the variables of the adjusting circuit when a desired result is seeked. An arrangement is included in the radiating plane for setting said distance. At the simplest, this arrangement means only that the direct distance between the points G and X is chosen to be suitable. In the example of FIG. 3 the arrangement comprises a notch 326 being located in the portion of the radiating plane between those points.

Figure 4:
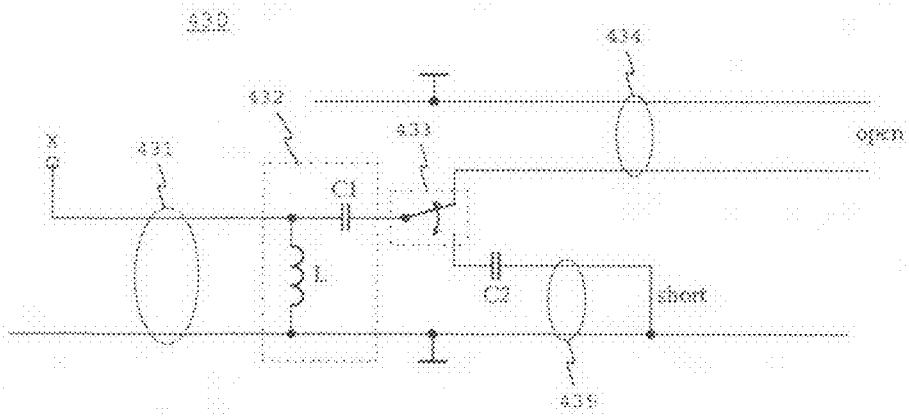
FIG. 4 presents an example of the adjusting circuit of an antenna according to the invention.

FIG. 4 shows an example of the adjusting circuit of an antenna according to the invention. The adjusting circuit 430 is galvanically connected to the antenna radiator at the adjusting point X. The adjusting circuit comprises, in order from the radiator, an input line 431 of the adjusting circuit, an LC circuit 432, a switch 433 and the tuning lines 434, 435. Each transmission line comprises a ground conductor and a conductor isolated from the ground, which conductor is also here called a separate conductor. The LC circuit 432 is on one hand for the ESD protection of the switch and on the other hand for increasing the number of the variable parameters of the adjusting circuit. It is formed of a coil L and a capacitor C1. The coil has been connected transversely to the input line 431, that is between its separate conductor and the ground. The capacitor C1 is in series with the separate conductor of the input line, and the second terminal of the capacitor is connected to the common pole of the switch 433. The switch is a two-way switch, where the common pole can be connected to one of two other poles. These other poles are called output poles of the switch. The first output pole of the switch is connected to the head end of the separate conductor of the first tuning line 434, and the second output pole is connected, through the capacitor C2, to the head end of the separate conductor of the second tuning line 435. Thus the input line of the adjusting circuit can continue, after the LC circuit and the switch, either as the first tuning line or as the second tuning line. When the switch state is changed, the reactive impedance, which is "seen" from the adjusting point X of the radiating plane to the ground, changes. In that case the resonance frequencies of the antenna parts change and the operating bands therefore shift.

In this example the first tuning line 434 is open at its tail end, and the second tuning line 435 is short-circuited at its tail end. The tuning lines are short, usually shorter than the quarter wavelength. In that case the open line represents a certain capacitance, and the short-circuited line represents a certain inductance. As known, the values of the capacitance and the inductance depend on the frequency: At the frequencies of the upper operating band they are higher than at the frequencies of the lower operating band, if the line is shorter than the quarter wavelength also in the upper band. The frequency-dependency of the capacitance in the discrete capacitor is just negligible. So the lengths of the tuning lines are used as variables in this invention when the adjusting circuit is designed. Among other things, the values of the discrete components of the adjusting circuit, the length of the input line 431 and the electric distance between the grounding point G and the adjusting point X in the radiating plane, mentioned in the description of FIG. 3, are other variables, or variable parameters Naturally, the starting point is the dimensioning of the antenna basic structure for part of the radiating plane. The number of the variables is high considering the simplicity of the adjusting circuit, and some variables have different frequency characteristics than some others. These facts make it possible to design the antenna with its adjusting circuit so that the displacements having desired directions and extents can be obtained for the lower and upper operating bands independently from each other. For example, if one band has to remain in its place, its displacement can be arranged as zero.

The capacitor C2 functions also as a blocking capacitor preventing the forming of a direct current circuit through the short-circuited tuning line as seen from the control circuit of the switch. On the side of the open tuning line, no blocking capacitor is needed, of course, but also there could be a discrete component for the tuning purpose.

The number of the switch operating states and of the tuning lines or circuits corresponding to those states can naturally be also more than two to implement several alternative places for an operating band. On the other hand, more than two operating bands may be implemented by the radiating plane, in which case the displacements of them all can be controlled by one adjusting circuit to some extent.

Figure 5:
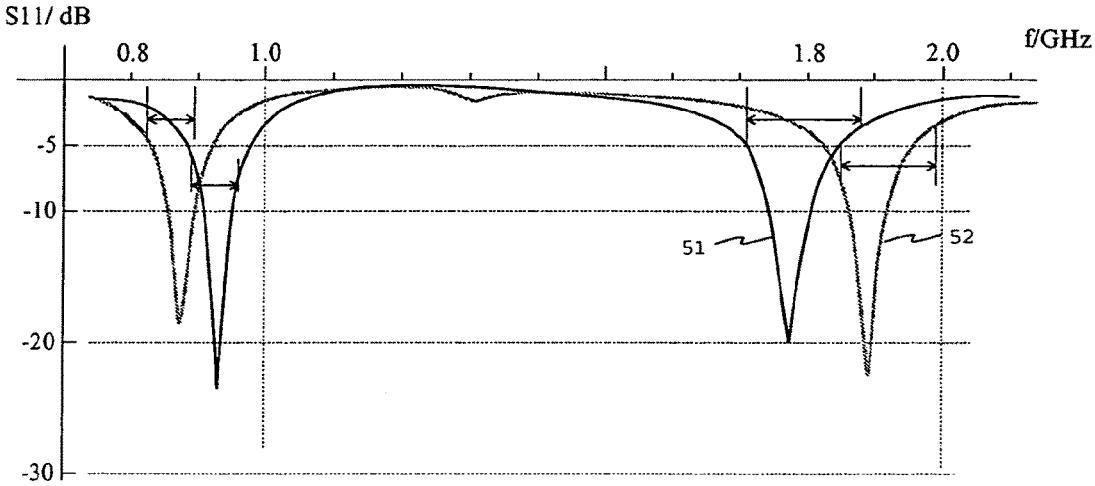
FIG. 5 presents an example of the displacement of operation bands of an antenna according to the invention.

FIG. 5 shows an example of the displacement of operation bands of an antenna according to the invention. The example relates to the antenna according to FIG. 3 comprising an adjusting circuit according to FIG. 4. The object has been that in one switch state the antenna's lower operating band would cover the frequency range 890-960 MHz of the GSM900 system and the upper operating band would cover the frequency range 1710-1880 MHz of the GSM1800 system, and that in the other switch state the lower operating band would cover the frequency range 824-894 MHz of the GSM850 system and the upper operating band would cover the frequency range 1850-1990 MHz of the GSM1900 system. Curve 51 shows fluctuation of the reflection coefficient as a function of frequency, when the radiator is connected to the short-circuited, very short tuning line. Curve 52 shows fluctuation of the reflection coefficient, when the radiator is connected to the tuning line, which is open at its tail end. From the curves can be seen that the above-mentioned object is fulfilled for part of the lower operating band, if the value −5 dB is considered as a criterion for the usable reflection coefficient. The object is fulfilled also for the upper operating band except for its uppermost part, where the antenna matching is only passable.

In the example of FIG. 5 the antenna adjusting circuit has been designed as follows: L=5.6 nH, C1=8.2 pF and C2=100 pF. The first tuning line 434 is a 3 mm long planar line on the surface of circuit board material FR-4. The length of the second tuning line as well as the length of the input line 431 of the adjusting circuit is practically zero. In that case, when the radiator is connected to the short-circuited tuning line, the whole adjusting circuit is "seen" from the radiator as a very short short-circuited transmission line at the frequencies of the lower operating band. This means a low impedance. Without the capacitor C2 the adjusting circuit would represent a short-circuited transmission line with about a ⅛ wavelength, but a value has been searched for the capacitance C2, which shortens the electric length of the transmission line to zero. At the frequencies of the upper operating band the capacitance C2 has only a minor effect. Because the upper operating band is located at about double frequencies compared with the lower band, the adjusting circuit is "seen" from the radiator as a short-circuited transmission line with about a quarter wavelength at the frequencies of the upper operating band. This means a high impedance. On the other hand, the adjusting circuit is designed so that when the radiator is connected to the open tuning line, the whole adjusting circuit is "seen" from the radiator as a very short open transmission line at the frequencies of the lower operating band. This means a high impedance. Without the coil L the adjusting circuit would represent an open transmission line with about a ⅛ wavelength, but a value has been searched for the inductance L, which shortens the electric length of the transmission line to zero. At the frequencies of the upper operating band the inductance L has only a minor effect. For this reason the adjusting circuit is "seen" from the radiator as an open transmission line with about a quarter wavelength at the frequencies of the upper operating band. This means a low impedance. These facts explain the directions of the displacements of the operating bands.

Another alternative would be to design the adjusting circuit so that when the radiator is connected to the open tuning line, the whole adjusting circuit would be "seen" as an open transmission line with about a quarter wavelength at the frequencies of the lower operating band, and correspondingly as an open transmission line with about a half wavelength at the frequencies of the upper operating band. On the other hand, when the radiator is connected to the short-circuited tuning line, the whole adjusting circuit would be "seen" as a short-circuited transmission line with about a quarter wavelength at the frequencies of the lower operating band, and correspondingly as a short-circuited transmission line with about a half wavelength at the frequencies of the upper operating band. Also in this case the impedance of the adjusting circuit would change from low to high in the lower operating band and from high to low in the upper operating band, when the switch state is changed. This again results in that the lower operating band shifts down-wards and the upper operating band shifts upwards, as in the previous case corresponding to the exemplary design. Using discrete components according to the invention, the physical lengths of the transmission lines needed are considerably shorter, for which reason the adjusting circuit fits into a smaller space.

Figure 6:
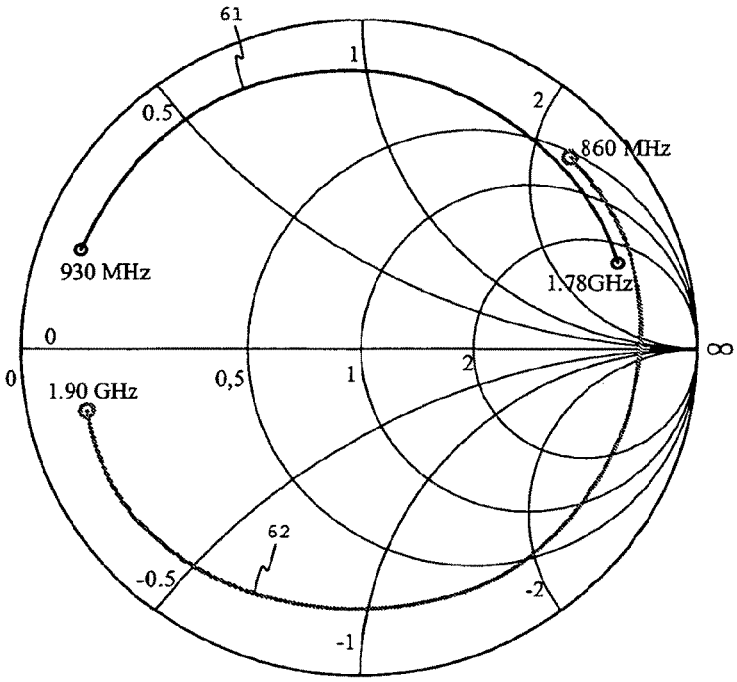
FIG. 6 presents changes in the impedance of the antenna adjusting circuit in the exemplary case of FIG. 5.

FIG. 6 shows as a Smith diagram an example of changes in the impedance of the adjusting circuit of an antenna according to the invention. The example relates to the same structure as the matching curves in FIG. 5. Curve 61 shows fluctuation of the impedance as a function of frequency, when the radiator is connected to the short-circuited, very short tuning line, curve 62 shows fluctuation of the impedance, when the radiator is connected to the tuning line, which is open at its tail end. In a lossless case the curves would travel along the outer circle of the diagram. Now they travel only relatively close to the outer circle, which means losses of a certain level in the adjusting circuit. These losses are included in the efficiency curves of FIG. 7.

The left end of the curve 61 represents the band used by GSM900 system and the right end represents the band used by GSM1800 system. In the previous band the adjusting circuit impedance is intended to be low, in which case particularly the resistive part of the impedance should be low. The resistive part is indeed only about 5% of the antenna characteristics impedance. In the band used by GSM1800 system the adjusting circuit impedance is intended to be high. In this example it is inductive and has an absolute value, which is about five times the antenna characteristics impedance. The left end of the curve 62 represents the band used by GSM1900 system and the right end represents the band used by GSM850 system. In the previous band the adjusting circuit impedance is intended to be low, in which case particularly the resistive part of the impedance should be low. The resistive part is indeed less than 10% of the antenna characteristics impedance. In the band used by GSM850 system the adjusting circuit impedance is intended to be high. In this example it is inductive and has an absolute value, which is nearly three times the antenna characteristics impedance.

Figure 7:
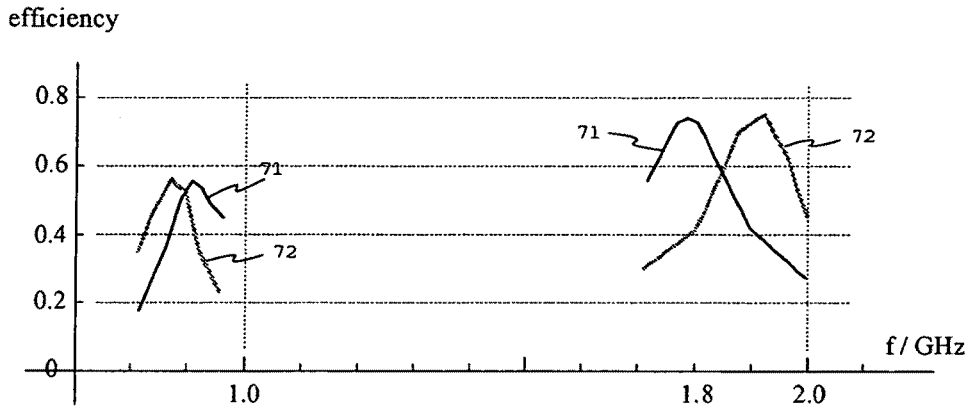
FIG. 7 presents the antenna efficiency in the exemplary case of FIG. 5.

FIG. 7 shows an example of the efficiency of an antenna according to the invention. The example concerns the same structure as the matching curves in FIG. 5. Curve 71 shows the fluctuation of the efficiency as a function of frequency when the radiator is connected to the short-circuited, very short tuning line. Curve 72 shows fluctuation of the efficiency when the radiator is connected to the tuning line, which is open at its tail end. It can be seen from the curves that the efficiency is better than 0.4 in the lower operating bands and better than 0.5 in the upper operating bands except for the very uppermost parts.

Figure 8:
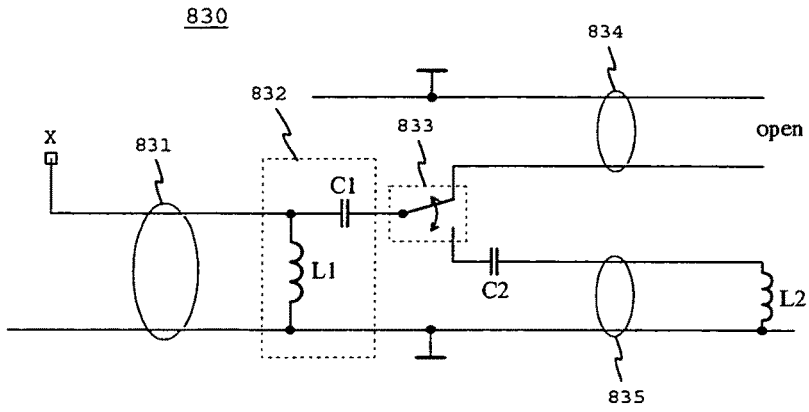
FIG. 8 presents another example of the adjusting circuit of an antenna according to the invention.

FIG. 8 shows another example of the adjusting circuit of an antenna according to the invention. The adjusting circuit 830 is galvanically connected to the antenna radiator at the adjusting point X. The adjusting circuit comprises, in order from the radiator, an input line 831 of the adjusting circuit, an LC circuit 832, a switch 833 and the tuning lines 834, 835, as in the circuit of FIG. 4. Similarly, the first output pole of the switch is connected to the head end of the separate conductor of the first tuning line 834, and the second output pole has been connected, through the capacitor C2, to the head end of the separate conductor of the second tuning line 835. Also in this example the first tuning line 834 is open at its tail end. The differences in respect of the circuit of FIG. 4 are: The tuning lines are now of equal length, the second tuning line is now terminated by a coil L2, and the capacitor C2 functions only as a blocking capacitor.

The antenna proper and the adjusting circuit are designed so that when the radiator is connected to the open tuning line, the antenna's upper operating band covers e.g. the frequency range of the GSM1800 system and the lower operating band covers e.g. the frequency range of the GSM850 system. At the frequencies of the lower operating band the adjusting circuit impedance is arranged to be relatively high. The inductance of the coil L2 is chosen so that its reactance in the upper operating band is relatively high. For this reason the adjusting circuit impedance hardly changes at the frequencies of the upper operating band when the radiator is connected to the tuning line, which is terminated by the coil L2. In that case the upper operating band remains nearly in its place. Instead, at the frequencies of the lower operating band the adjusting circuit impedance becomes lower so that the lower operating band shifts upwards for example to the range used by the GSM900 system.

Another way to limit the effect of the switch to one operating band is to implement the LC circuit between the radiator and the switch as a filter, the cut-off frequency of which is located between the lower and upper operating bands of the antenna. When the object is to displace only the upper operating band, the filter is of high-pass type, and when the object is to displace only the lower operating band, the filter is of low-pass type. The order of the filter is naturally selectable. Also this kind of filter functions at the same time as an ESD protector for the switch. For this aim a high-pass part can be added to the low-pass filter so that a bandpass filter is formed.

Figure 9:
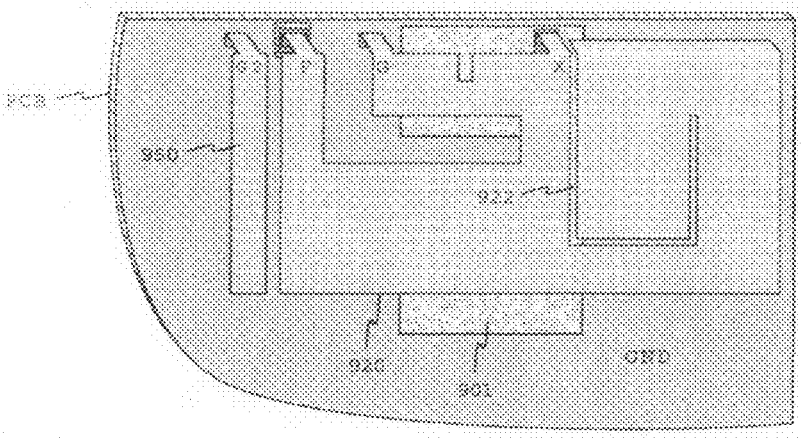
FIG. 9 presents another example of an antenna according to the invention.

FIG. 9 shows another example of an antenna according to the invention as seen from above, or from the side of the radiating plane. For its inventive part the antenna is similar to the antenna presented in FIG. 3. One difference is that the antenna in FIG. 9 further comprises a parasitic radiator 950. This is located beside the end of the radiating plane 920 on the side of the feeding point F, and is connected to the ground plane at the grounding point G2 next to the feeding point F. Changing the resonance frequencies of the main radiator hardly affects the resonance frequency of the parasitic element because of its location. The resonance frequency of the parasitic element can be arranged e.g. into the range of 2.2 GHz so that an operating band is obtained for the antenna in the frequency range used by the WCDMA system (Wideband Code Division Multiple Access).

The antenna in FIG. 9 lacks ground plane on a relatively large area 901 below the radiating plane. This feature has nothing to do with the above-mentioned parasitic radiator: An antenna according to the invention does not require a "solid" ground plane below the radiating plane. The ground plane can be located even considerably more aside from the radiating plane than in the example of FIG. 9.

Figure 10:
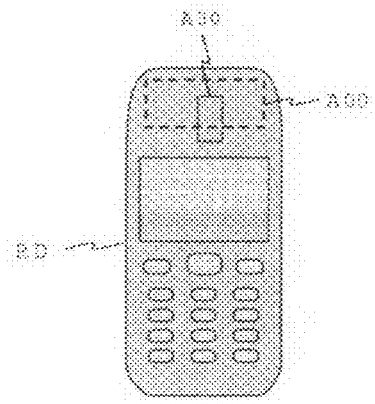
FIG. 10 presents an example of a radio device equipped with an antenna according to the invention.

FIG. 10 shows a radio device RD, which comprises an adjustable multiband antenna A00 according to the invention with its adjusting circuit A30.

The adjustable multiband antenna according to the invention has been described above. Its structure can naturally differ from that presented. The invention does not limit the manufacturing method of the antenna. The antenna can be e.g. ceramic, in which case the radiators are conductive coatings of the ceramics. The switch used in the adjusting circuit can be of e.g. the FET (Field Effect Transistor), PHEMT (Pseudomorphic High Electron Mobility Transistor) or MEMS (Micro Electro Mechanical System) type. It is possible to use a capacitance diode as the adjusting component, too. The inventive idea can be applied in different ways within the scope defined by the independent claim 1.

The invention claimed is:

1. An adjustable antenna having at least a lower and an upper operating band and comprising:

a ground plane;

a radiating plane; and an adjusting circuit configured to displace at least one of said lower and upper operating bands, said adjusting circuit comprising:

an LC circuit with an input coupled to the radiating plane;

a switch with its fixed end coupled to an output of the LC circuit; and at least two tuning lines, the first of which is coupled to a first output pole of the switch and the second of said tuning lines coupled to a second output pole of the switch.

2. The antenna of claim 1, wherein an electric distance in the radiating plane between a grounding point and an adjusting point is arranged for desired displacements of the operating bands.

3. The antenna of claim 1, wherein the length of said tuning lines is at the most a fifth of the wavelength corresponding to the highest utilization frequency of the antenna.

4. The antenna of claim 1, wherein the first tuning line of the adjusting circuit is open at its tail end and the second tuning line is short-circuited at its tail end, and the adjusting circuit further comprises a capacitor connected between the second output pole of the switch and a separate conductor of the second tuning line.

5. The antenna of claim 4, wherein the radiating plane is coupled to the second tuning line, the adjusting circuit corresponds to a short-circuited transmission line with a quarter wavelength in the upper operating band, and the capacitance of the capacitor is arranged so that the adjusting circuit corresponds to a short-circuited transmission line with a zero length in the lower operating band, and when the radiating plane is connected to the first tuning line, the adjusting circuit corresponds to an open transmission line with a quarter wavelength in the upper operating band and the inductance of a coil of the LC circuit is arranged so that the adjusting circuit corresponds to an open transmission line with a zero length in the lower operating band.

6. The antenna of claim 1, wherein the first tuning line of the adjusting circuit is open at its tail end and the second tuning line is terminated by another coil at its tail end to keep the upper operating band in its place when the state of the switch changes.

7. The antenna of claim 1, wherein the length of the tuning lines is less than a twentieth of the wavelength corresponding to the highest utilization frequency of the antenna.

8. The antenna of claim 1, wherein the number of the output poles of the switch is at least three to increase the number of alternative places of at least one operating band.

9. The antenna of claim 1, wherein said LC circuit comprises an ESD protector of the switch.

10. The antenna of claim 1, wherein said LC circuit comprises a low-pass filter, said low-pass filter configured to limit the effect of a change in the switch state to the lower operating band.

11. The antenna of claim 1, wherein said LC circuit comprises a high-pass filter, said high-pass filter configured to limit the effect of a change in the switch state to the upper operating band.

12. An adjustable antenna having at least a lower and an upper operating band and comprising:

a ground plane;

a radiating plane; and an adjusting circuit to displace at least one operating band of the antenna;

wherein said radiating plane comprises a feeding point, a grounding point, an adjusting point of the antenna and two radiating parts having different electric lengths so as to implement said lower and upper operating bands;

wherein said adjusting circuit comprises an LC circuit with its input galvanically coupled to the radiating plane at said adjusting point, a switch with its common pole connected to an output of the LC circuit, and at least two tuning lines; and wherein the electric distance in the radiating plane between the grounding point and the adjusting point is arranged for desired displacements of the operating bands, and the length of said tuning lines is at the most a fifth of the wavelength corresponding to the highest utilization frequency of the antenna.

13. The antenna of claim 12, wherein the first of said tuning lines is coupled at its head end to a first output pole of the switch, and the second of said tuning lines is coupled at its head end to a second output pole of the switch to arrange alternative impedances between the adjusting point and ground, thus displacing the operating bands of the antenna; and wherein the first tuning line of the adjusting circuit is open at its tail end and the second tuning line is short-circuited at its tail end, and the adjusting circuit further comprises a capacitor connected between the second output pole of the switch and a separate conductor of the second tuning line.

14. The antenna of claim 13, wherein the radiating plane is connected to the second tuning line, the adjusting circuit corresponds to a short-circuited transmission line with a quarter wavelength in the upper operating band, and the capacitance of the capacitor is arranged so that the adjusting circuit corresponds to a short-circuited transmission line with a zero length in the lower operating band, and when the radiating plane is connected to the first tuning line, the adjusting circuit corresponds to an open transmission line with a quarter wavelength in the upper operating band and the inductance of a coil of the LC circuit is arranged so that the adjusting circuit corresponds to an open transmission line with a zero length in the lower operating band.

15. The antenna of claim 12, wherein the first tuning line of the adjusting circuit is open at its tail end and the second tuning line is terminated by another coil at its tail end to keep the upper operating band in its place when the state of the switch changes.

16. The antenna of claim 12, wherein the radiating plane comprises a shaping to arrange said electric distance between the grounding point and the adjusting point.

17. The antenna of claim 12, wherein the length of the tuning lines is less than a twentieth of the wavelength corresponding to the highest utilization frequency of the antenna.

18. The antenna of claim 12, wherein the number of the output poles of the switch is at least three to increase the number of alternative places of at least one operating band.

19. The antenna of claim 12, wherein said LC circuit comprises an ESD protector of the switch.

20. The antenna of claim 12, wherein said LC circuit comprises a low-pass filter to limit the effect of a changing of the switch state to the lower operating band.

21. The antenna of claim 12, wherein said LC circuit comprises a high-pass filter to limit the effect of a changing of the switch state to the upper operating band.

22. The antenna of claim 12, wherein said switch is selected from the group consisting of: the (i) FET, (ii) PHEMT or (iii) MEMS types.

23. An adjustable antenna, comprising:

at least a lower and an upper operating band;

a ground plane;

a radiating plane; and an adjusting circuit to displace at least one operating band of the antenna, said radiating plane comprising a feeding point, a grounding point, an adjusting point of the antenna and two radiating parts having different electric length to implement said lower and upper operating bands;

wherein said adjusting circuit comprises an LC circuit with its input coupled to the radiating plane at said adjusting point, a switch with its common pole electrically coupled to the output of the LC circuit, and at least two tuning lines, the first of which is coupled at its head end to a first output pole of the switch and the second of which tuning lines is coupled at its head end to a second output pole of the switch to arrange alternative impedances between the adjusting point and ground and thus to displace the operating bands of the antenna; and wherein the electric distance in the radiating plane between the grounding point and the adjusting point is arranged for desired displacements of the operating bands, and the length of said tuning lines is at the most a fifth of the wavelength corresponding to the highest utilization frequency of the antenna.

24. An antenna according to claim 23, wherein the first tuning line of the adjusting circuit is open at its tail end and the second tuning line is short-circuited at its tail end, and the adjusting circuit further comprises a capacitor connected between the second output pole of the switch and a separate conductor of the second tuning line.

25. An antenna according to claim 24, characterized in that when the radiating plane is connected to the second tuning line, the adjusting circuit corresponds to a short-circuited transmission line with a quarter wavelength in the upper operating band, and the capacitance of the capacitor is arranged so that the adjusting circuit corresponds to a short-circuited transmission line with a zero length in the lower operating band, and when the radiating plane is connected to the first tuning line, the adjusting circuit corresponds to an open transmission line with a quarter wavelength in the upper operating band and the inductance of a coil of the LC circuit is arranged so that the adjusting circuit corresponds to an open transmission line with a zero length in the lower operating band.

26. An antenna according to claim 23, wherein the first tuning line of the adjusting circuit is open at its tail end and the second tuning line is terminated by another coil at its tail end to keep the upper operating band in its place when the state of the switch changes.

27. An antenna according to claim 23, wherein the radiating plane comprises a shaping to arrange said electric distance between the grounding point and the adjusting point.

28. An antenna according to claim 23, wherein the length of the tuning lines is less than a twentieth of the wavelength corresponding to the highest utilization frequency of the antenna.

29. An antenna according to claim 23, wherein the number of the output poles of the switch is at least three to increase the number of alternative places of at least one operating band.

30. An antenna according to claim 23, wherein said LC circuit comprises an ESD protection device for the switch.

31. An antenna according to claim 23, wherein said LC circuit comprises a low-pass filter adapted to limit the effect of a changing of the switch state to the lower operating band.

32. An antenna according to claim 23, wherein said LC circuit comprises a high-pass filter to limit the effect of a changing of the switch state to the upper operating band.

33. An antenna according to claim 23, wherein said switch is selected from the group consisting of: (i) FET, (ii) PHEMT, or (iii) MEMS type.

34. A radio device, comprising:

a radio transceiver circuit; and an adjustable multiband antenna having at least a lower and an upper operating band, said antenna comprising:

a ground plane;

a radiating plane; and an adjusting circuit configured to displace at least one of said lower and upper operating bands;

wherein said adjusting circuit comprises:

an inductive-capacitive (LC) circuit with an input coupled to the radiating plane;

a switch with its fixed end coupled to an output of the LC circuit; and at least two tuning lines, the first of which is coupled to a first output pole of the switch and the second of said tuning lines coupled to a second output pole of the switch.

35. The radio device of claim 34, wherein the first tuning line of the adjusting circuit is open at a tail end thereof and the second tuning line is terminated by another coil at a tail end thereof to keep the upper operating band substantially fixed when a state of the switch changes.

36. The radio device of claim 34, wherein the length of the tuning lines is less than one-twentieth of a wavelength corresponding to a highest utilization frequency of the antenna.

37. The radio device of claim 34, wherein a number of output poles of the switch is at least three to increase a number of alternative places of at least one operating band.

38. The radio device of claim 34, wherein the LC circuit comprises an electrostatic discharge (ESD) protection device for the switch.

39. The radio device of claim 34, wherein said LC circuit comprises a low-pass filter configured to limit an effect of a changing of the switch state to the lower operating band.

* * * * *